US007742723B2

(12) United States Patent
Aruga et al.

(10) Patent No.: US 7,742,723 B2
(45) Date of Patent: Jun. 22, 2010

(54) DEVELOPING DEVICE HAVING CLEANING BLADE FOR CLEANING DEVELOPMENT ROLLER

(75) Inventors: Tomoe Aruga, Komagane (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/335,315

(22) Filed: Dec. 15, 2008

(65) Prior Publication Data

US 2009/0103948 A1 Apr. 23, 2009

Related U.S. Application Data

(62) Division of application No. 11/552,074, filed on Oct. 23, 2006, now Pat. No. 7,493,066.

(30) Foreign Application Priority Data

| | | |
|---|---|---|
| Oct. 25, 2005 | (JP) | 2005-309646 |
| Oct. 25, 2005 | (JP) | 2005-309647 |
| Oct. 25, 2005 | (JP) | 2005-309648 |
| Oct. 25, 2005 | (JP) | 2005-309649 |
| Oct. 25, 2005 | (JP) | 2005-309650 |
| Oct. 25, 2005 | (JP) | 2005-309651 |

(51) Int. Cl.
*G03G 15/10* (2006.01)

(52) U.S. Cl. ..... 399/239

(58) Field of Classification Search ..... 399/239, 399/286, 240, 237, 57
See application file for complete search history.

(56) References Cited

U.S. PATENT DOCUMENTS

| | | | | |
|---|---|---|---|---|
| 5,610,694 | A | 3/1997 | Lior et al. | 399/240 |
| 6,311,034 | B1 * | 10/2001 | Nakashima et al. | 399/239 |
| 6,363,234 | B2 | 3/2002 | Landa et al. | 399/249 |
| 2002/0098016 | A1 | 7/2002 | Kurotori et al. | 399/237 |
| 2005/0069348 | A1 | 3/2005 | Fujita et al. | 399/237 |

FOREIGN PATENT DOCUMENTS

| | | |
|---|---|---|
| JP | 2000-056576 | 2/2000 |
| JP | 2002-189354 | 7/2002 |
| JP | 2002-296918 | 10/2002 |

* cited by examiner

*Primary Examiner*—Quana M Grainger
(74) *Attorney, Agent, or Firm*—Hogan & Hartson LLP

(57) ABSTRACT

The invention provides a developing device employing a liquid developer which is capable of effectively cleaning a development roller or the like having an elastic outer layer. The developing device of the invention is provided with an elastic roller such as a development roller for developing a latent image formed on an image carrier. In image forming process, toner particles uniformly dispersed in carrier are agglutinated to the elastic roller side by means of compaction. A cleaning blade is provided for cleaning the agglutinated toner particles. Assuming that an angle of a contact face of the cleaning blade relative to a perpendicular line perpendicular to a generating line of the elastic roller at a contact point where the tip end of the cleaning blade is pressed against and in contact with the elastic roller is θ and an angle of a rising contour of a deformed portion of the elastic outer layer which is deformed by the pressure of the cleaning blade against the elastic roller relative to the perpendicular line is a, a relation a>θ is established.

3 Claims, 10 Drawing Sheets

DEVELOPING DEVICE HAVING CLEANING BLADE FOR CLEANING DEVELOPMENT ROLLER

CROSS-REFERENCE TO RELATED APPLICATIONS

This application is a divisional of application Ser. No. 11/552,074 filed on Oct. 23, 2006, the entire contents of which are incorporated herein by reference. This application is based on Japanese Patent Applications No. 2005-309646 filed on Oct. 25, 2005, No. 2005-309647 filed on Oct. 25, 2005, No. 2005-309648 filed on Oct. 25, 2005, No. 2005-309649 filed on Oct. 25, 2005, No. 2005-309650 filed on Oct. 25, 2005, and No. 2005-309651 filed on Oct. 25, 2005, the entire contents including specifications, claims, drawings, and abstracts of which are incorporated herein by reference.

BACKGROUND

The present invention relates to an image forming apparatus employing a liquid developer, in which a latent image formed on an image carrier is developed by a developing device using a liquid developer, the developed image is transferred from the image carrier to an intermediate transfer member at a primary transfer position of a primary transfer section, and the transferred developed image is transferred from the intermediate transfer member to a recording medium at a secondary transfer position of a secondary transfer section.

There have been proposed various wet-type image forming apparatuses capable of visualizing an electrostatic latent image by developing the latent image with a high concentration liquid developer containing a liquid solvent and a toner as solid substance dispersed therein. The developer employed in the wet-type image forming apparatus is formed by suspending solid substance (toner particles) in an electrical insulating organic solvent (carrier liquid) such as silicone oil, mineral oil, or cooking oil. The toner particles are very fine, for example, of about 1 μm in particle diameter. By employing such fine toner particles, the wet-type image forming apparatus can form high quality images as compared to a dry-type image forming apparatus employing powder-type toner particles of about 7 μm in particle diameter.

The carrier liquid composing the developer has not only a function of preventing the toner particles of about 1 μm in particle diameter from scattering, but also a function of making the toner particles charged and making the toner particles uniformly dispersed, and also a function of facilitating the transfer of toner particles by electric field during deployment and transfer process. Though the carrier liquid is a necessary ingredient for the toner conservation, the toner transport, the development, and the transfer process as mentioned above, the carrier liquid adheres also to non-imaging regions and the excess carrier liquid after development may cause deterioration of transfer. Accordingly, such a function is normally performed as to remove (squeeze) carrier liquid on the photoconductor and the intermediate transfer member (for example, JP-A-2002-296918). In addition, such a function is performed as to apply bias voltage on a roller such as a development roller so that the toner particles uniformly dispersed in the carrier liquid move and agglutinate to the surface of the roller (for example, JP-A-2000-56576). In the wet-type image forming apparatus comprising an intermediate transfer belt and further a secondary transfer belt, such a function is performed as to remove liquid developer (carrier liquid and solid substance) adhering to the belt surface by a cleaning blade (for example, JP-A-2002-189354).

SUMMARY

By the way, such a cleaning arrangement of an image forming apparatus using liquid developer as mentioned above that the cleaning is conducted by moving a cleaning blade made of urethane rubber to slide with being in contact with a member to be cleaned is partly effective in cleaning a roller having a rigid surface such as an image carrier, but hardly achieves effective cleaning of a roller having an elastic surface such as a development roller. Particularly, in a case that an electric filed is applied from a compaction roller or a corona discharger to a development roller carrying toner particles uniformly dispersed in carrier liquid thereon so that the toner particles move and agglutinate to the development roller side, it is very difficult to clean the compaction state developer from the development roller. Not only for cleaning the development roller but also for cleaning any of rollers having elastic surface disposed at certain locations in the image forming apparatus, there is a problem that cleaning condition is severe and effective cleaning is difficult.

The present invention was made for solving the aforementioned problems. The invention according to claim 1 is a developing device comprising a development roller having an elastic outer layer and a development roller cleaning blade which is in contact with the development roller to clean the surface of the development roller, the development roller having a compaction mechanism, wherein assuming that θ is an angle of a contact face of the development roller cleaning blade relative to a perpendicular line perpendicular to a generating line of the development roller at a contact point where the tip end of the development roller cleaning blade is pressed against and in contact with the development roller and a is an angle of a rising contour of a deformed portion of the elastic outer layer which is deformed by the pressure of the development roller cleaning blade against the development roller relative to the perpendicular line, the hardness of the development roller and the attitude of the development roller cleaning blade are set to achieve a relation $a>\theta$.

The invention is a developing device, wherein the angle θ is in a range of from 6° to 30° .

The invention is a developing device, wherein the elastic outer layer is made of a rubber having a JIS A hardness of from 30 to 50 degrees.

The invention is a developing device, wherein said rubber is covered by a tube so as to have a JIS A hardness of from 35 to 55 degrees.

The invention is a developing device comprising a development roller having an elastic outer layer and a development roller cleaning blade which is in contact with the development roller to clean the surface of the development roller, wherein the development roller has a compaction mechanism, and the elastic outer layer is made of a rubber having a JIS A hardness of from 30 to 50 degrees.

The invention is a developing device comprising a development roller having an elastic outer layer and a development roller cleaning blade which is in contact with the development roller to clean the surface of the development roller, wherein the development roller has a compaction mechanism, and the elastic outer layer is formed by covering a rubber having a JIS A hardness of from 30 to 50 degrees with a tube so as to have a JIS A hardness of from 35 to 55 degrees.

The invention is a developing device, wherein the rubber is polyurethane rubber, urethane rubber, silicone rubber, or NBR.

The invention is a developing device, wherein the development roller cleaning blade is made of a polyurethane rubber having a JIS A hardness of from 60 to 100 degrees.

The invention is a developing device, wherein a resin of fluorine series is fixed to a contact face of the development roller cleaning blade relative to the development roller.

The invention is a developing device comprising a development roller having an elastic outer layer and a development roller cleaning blade which is in contact with the development roller to clean the surface of the development roller, wherein the development roller has a compaction mechanism, and the elastic outer layer is formed by covering a formed rubber having a ASKER C hardness of from 30 to 50 degrees with a tube so as to have a ASKER C hardness of from 40 to 60 degrees.

The invention is a developing device, wherein the foamed rubber is polyurethane rubber, silicone rubber, or NBR.

The invention is a developing device, wherein the development roller cleaning blade is made of a polyurethane rubber having a JIS A hardness of from 60 to 100 degrees.

The invention is a developing device, wherein a resin of fluorine series is fixed to a contact face of the development roller cleaning blade relative to the development roller.

The invention is a developing device comprising a development roller having an elastic outer layer and a development roller cleaning blade which is in contact with the development roller to clean the surface of the development roller, wherein the development roller has a compaction mechanism, and the elastic outer layer is formed to have ASKER C hardness of from 30 to 50 degrees to comprise a foamed portion having lower density and a non-foamed portion having higher density which is made of the same material as the foamed portion, such that the nearer to the outer surface of the roller, the higher the density is.

The invention is a developing device as, wherein the material is polyurethane foam, polystyrene foam, polyethylene foam, elastomer foam, or rubber foam.

The invention is a developing device, wherein the development roller cleaning blade is made of a polyurethane rubber having a JIS A hardness of from 60 to 100 degrees.

The invention is a developing device, wherein a resin of fluorine series is fixed to a contact face of the development roller cleaning blade relative to the development roller.

The invention is a developing device comprising a development roller having an elastic outer layer and a development roller cleaning blade which is in contact with the development roller to clean the surface of the development roller, wherein the development roller has a compaction mechanism, and a concave is formed in the elastic outer layer of the development roller by pressing the tip end of the development roller cleaning blade against the elastic outer layer and a convex is formed on the elastic outer layer because a volume of the concave is shifted.

The invention is an image forming apparatus comprising: an image carrier; a development roller for developing a latent image formed on the image carrier, the development roller having an elastic outer layer; and a development roller cleaning blade which is in contact with the development roller to clean the surface of the development roller, the development roller having a compaction mechanism, wherein assuming that θ is an angle of a contact face of the development roller cleaning blade relative to a perpendicular line perpendicular to a generating line of the development roller at a contact point where the tip end of the development roller cleaning blade is pressed against and in contact with the development roller and a is an angle of a rising contour of a deformed portion of the elastic outer layer which is deformed by the pressure of the development roller cleaning blade against the development roller relative to the perpendicular line, the hardness of the development roller and the attitude of the development roller cleaning blade are set to achieve a relation $a>\theta$ .

According to the invention, even after toner particles are agglutinated to the intermediate transfer member side by a bias voltage of a polarity opposite to the charging polarity of the toner particles in liquid developer so that the toner particles become into the compaction state, concave and convex are formed by elastically deforming an elastic layer of a development roller, frictional force generated at a portion pressed by a cleaning blade is reduced, and adhering force of toner particles carried by the surface of the development roller is also reduced, thereby exhibiting excellent cleaning function.

DESCRIPTION OF EXEMPLARY EMBODIMENTS

Figure 1:
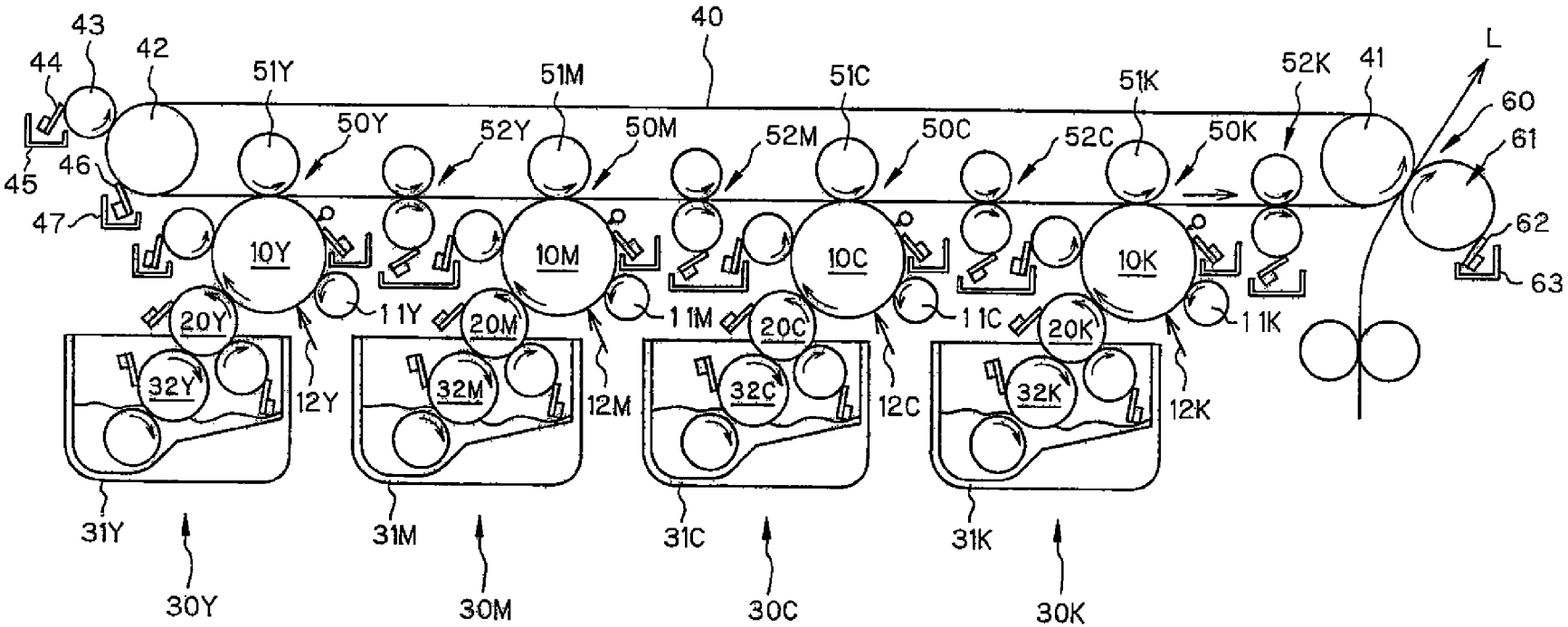
FIG. 1 is an illustration showing main components composing an image forming apparatus according to an embodiment of the invention.

Hereinafter, embodiments of the invention will be described with referred to the attached drawings. FIG. 1 is an illustration showing main components composing an image forming apparatus according to an embodiment of the invention. The image forming apparatus comprises image forming sections of respective colors which are arranged at a center portion thereof. Relative to the image forming sections, developing units 30Y, 30M 30C, and 30K are located in a lower portion of the image forming apparatus, and an image transfer member 40 and a secondary transfer section 60 are located in an upper portion of the image forming apparatus.

The image forming sections comprise image carriers 10Y, 10M, 10C, 10K, charging rollers 11Y, 11M, 11C, 11K, exposure units 12Y, 12M, 12C, 12K (not shown), and the like, respectively. The exposure units 12Y, 12M, 12C, and 12K have optical systems such as a semiconductor lasers, polygon mirrors, F-x lenses. The image carriers 10Y, 10M, 10C, 10K are uniformly charged by the charging rollers 11Y, 11M, 11C, 11K. According to image signals inputted, the exposure units 12Y, 12M, 12C, 12K radiate modulated laser beams onto the charged image carriers 10Y, 10M, 10C, 10K so as to form electrostatic latent images on the image carriers 10Y, 10M, 10C, 10K.

The developing units 30Y, 30M, 30C, 30K mainly comprise development rollers 20Y, 20M, 20C, 20K, developer containers (reservoirs) 31Y, 31M, 31C, 31K in which liquid developers of respective colors i.e. yellow (Y), magenta (M), cyan (C), and black (K) are stored, developer supplying rollers 32Y, 32M, 32C, 32K for supplying the liquid developers of respective colors from the developer containers 31Y, 31M, 31C, 31K to the development rollers 20Y, 20M, 20C, 20K. The developing units 30Y, 30M, 30C, 30K develop the electrostatic latent images formed on the image carriers 10Y, 10M, 10C, 10K with the liquid developers of respective colors.

The intermediate transfer member 40 is an endless belt and is laid to extend around and between a driving roller 41 and a tension roller 42 with some tension and is driven to circle by the driving roller 41 such that the intermediate transfer member 40 is in contact with the image carriers 10Y, 10M, 10C, 10K at primary transfer sections 50Y, 50M, 50C, 50K. At the primary transfer sections 50Y, 50M, 50C, 50K, primary transfer rollers 51Y, 51M, 51C, 51K are arranged to face the image carriers 10Y, 10M, 10C, 10K with the intermediate transfer member 40 therebetween such that the contact positions relative to the image carriers 10Y, 10M, 10C, 10K are transfer positions. The developed toner images of respective colors on the image carriers 10Y, 10M, 10C, 10K are transferred sequentially to the intermediate transfer member 40 and are superposed on each other, thereby forming a full-color toner image.

The second transfer unit 60 comprises a secondary transfer roller 61 which is arranged to face the belt driving roller 41 with the intermediate transfer member 40 therebetween, and further a cleaning device. The cleaning device comprises a secondary transfer roller cleaning blade 62 and a developer collecting portion 63. At the transfer position where the secondary transfer roller 61 is located, a single-color toner image or a full-color toner image formed on the intermediate transfer member 40 is transferred to a recording medium such as a paper, a film, or a cloth which is fed through a sheet carrying passage L.

In addition, a fixing unit (not shown) is disposed in front of the sheet carrying passage L and fuses the single toner image or the full-color toner image transferred to the recording medium such as a paper so that the single toner image or the full-color toner image is fixed to the recording medium.

Arranged around the outer periphery of the tension roller 42 which cooperates with the belt driving roller 41 to support the intermediate transfer member 40 are an intermediate transfer member compaction roller 43 which is disposed to be in contact with the intermediate transfer member 40, and a cleaning device which is located downstream of the intermediate transfer member compaction roller 43 in the moving direction of the intermediate transfer member 40. The cleaning device comprises an intermediate transfer member cleaning blade 46 and a developer collecting portion 47. On the outer periphery of the intermediate transfer member compaction roller 43, a compaction roller cleaning blade 44 and a developer collecting portion 45 are disposed to face the intermediate transfer member compaction roller 43. Applied to the intermediate transfer member compaction roller 43 is a bias voltage of a polarity of pressing the toner remaining on the intermediate transfer member 40 to the intermediate transfer member 40.

Figure 2:
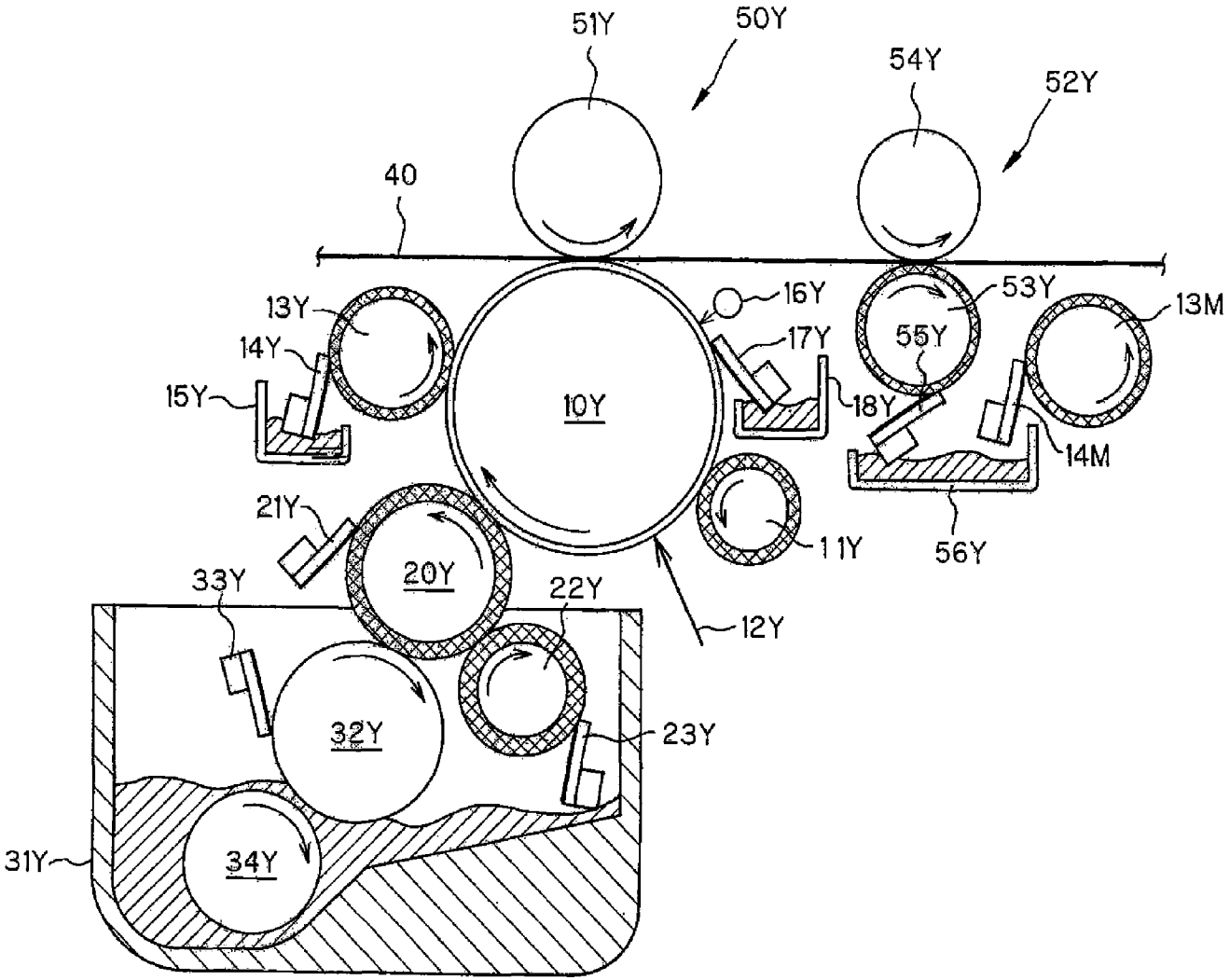
FIG. 2 is a sectional view showing main components composing an image forming section and a developing unit.
Figure 3:
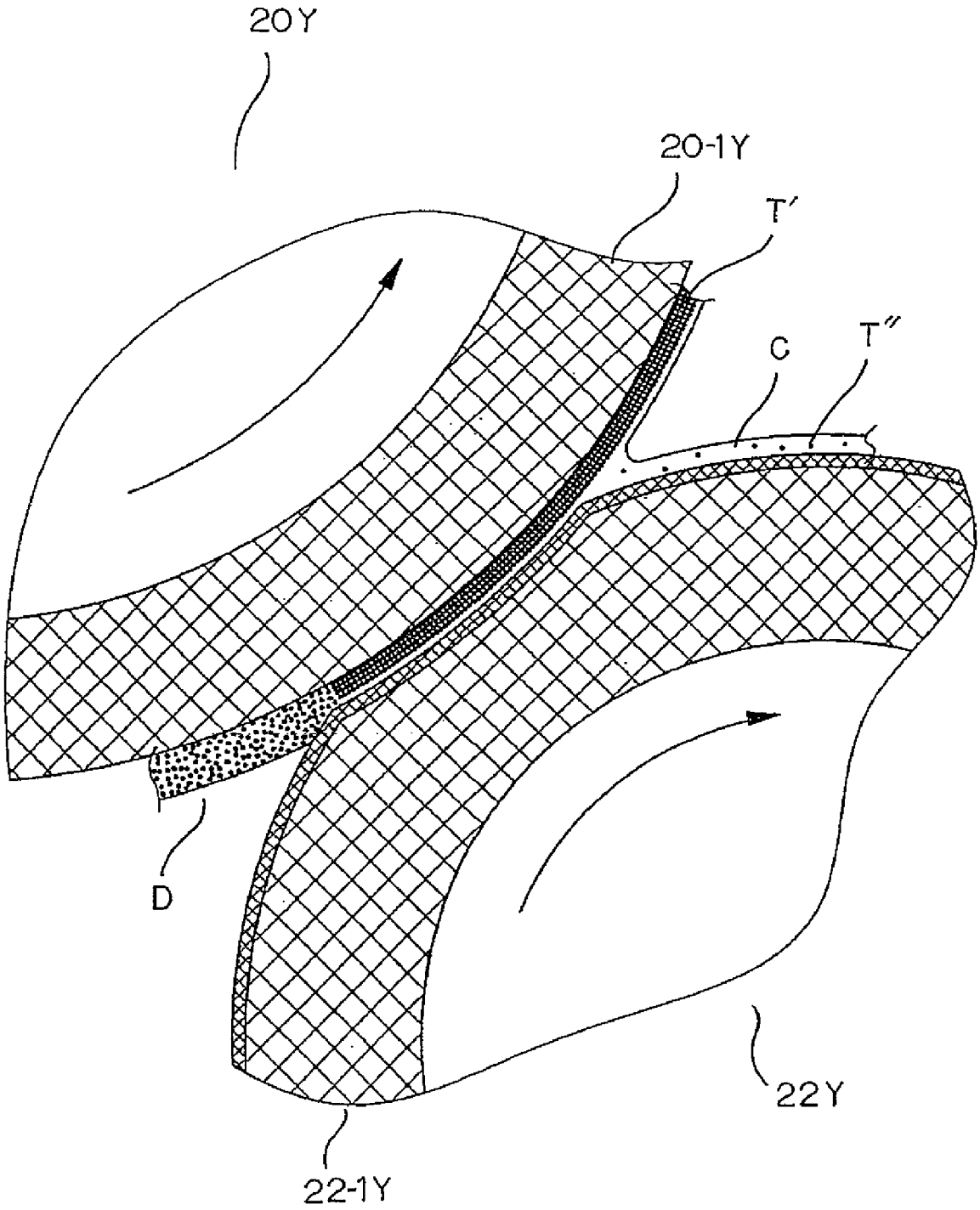
FIG. 3 is an illustration for explaining compaction by a compaction roller 22Y.
Figure 4:
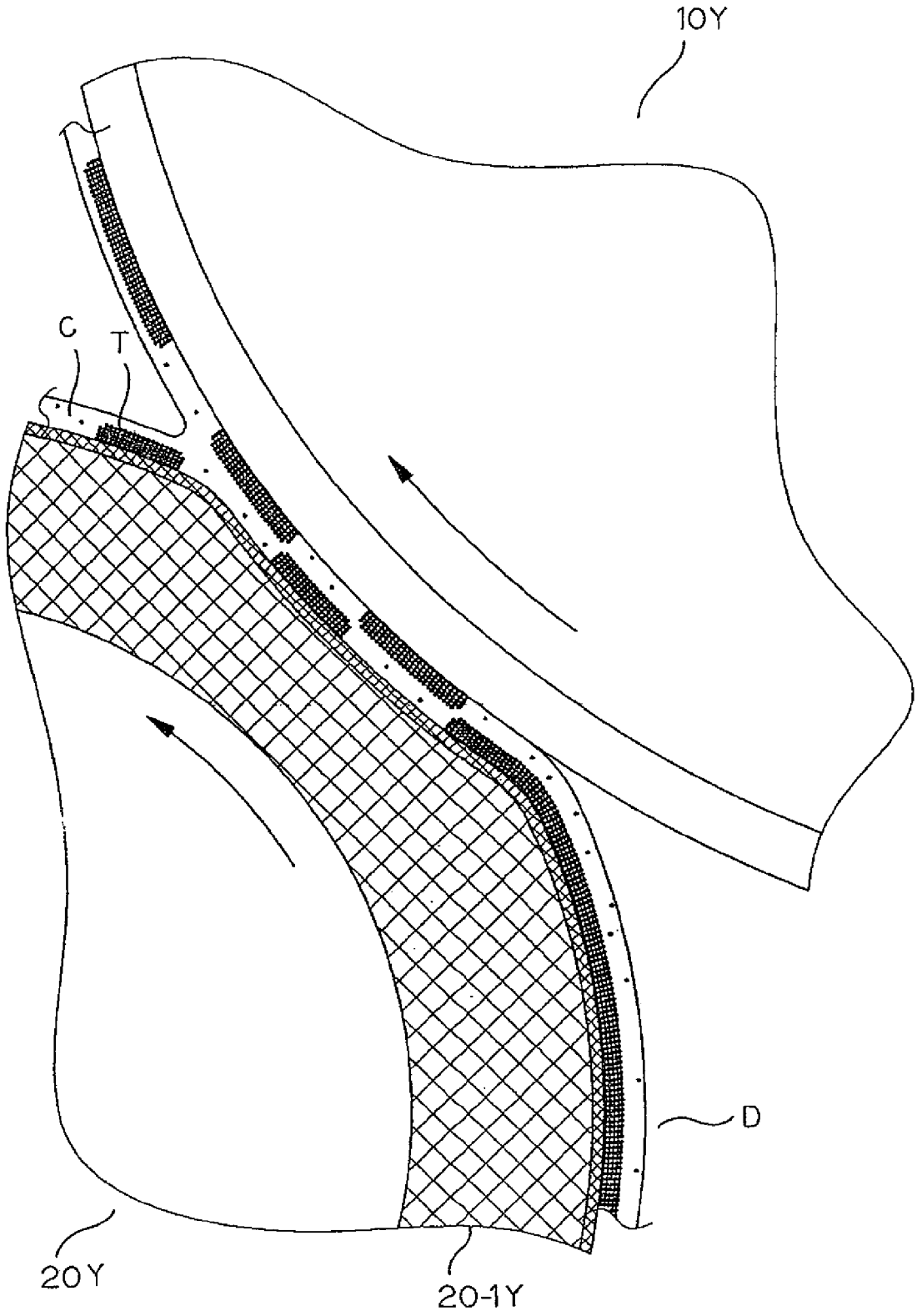
FIG. 4 is an illustration for explaining development by a development roller 20Y.
Figure 5:
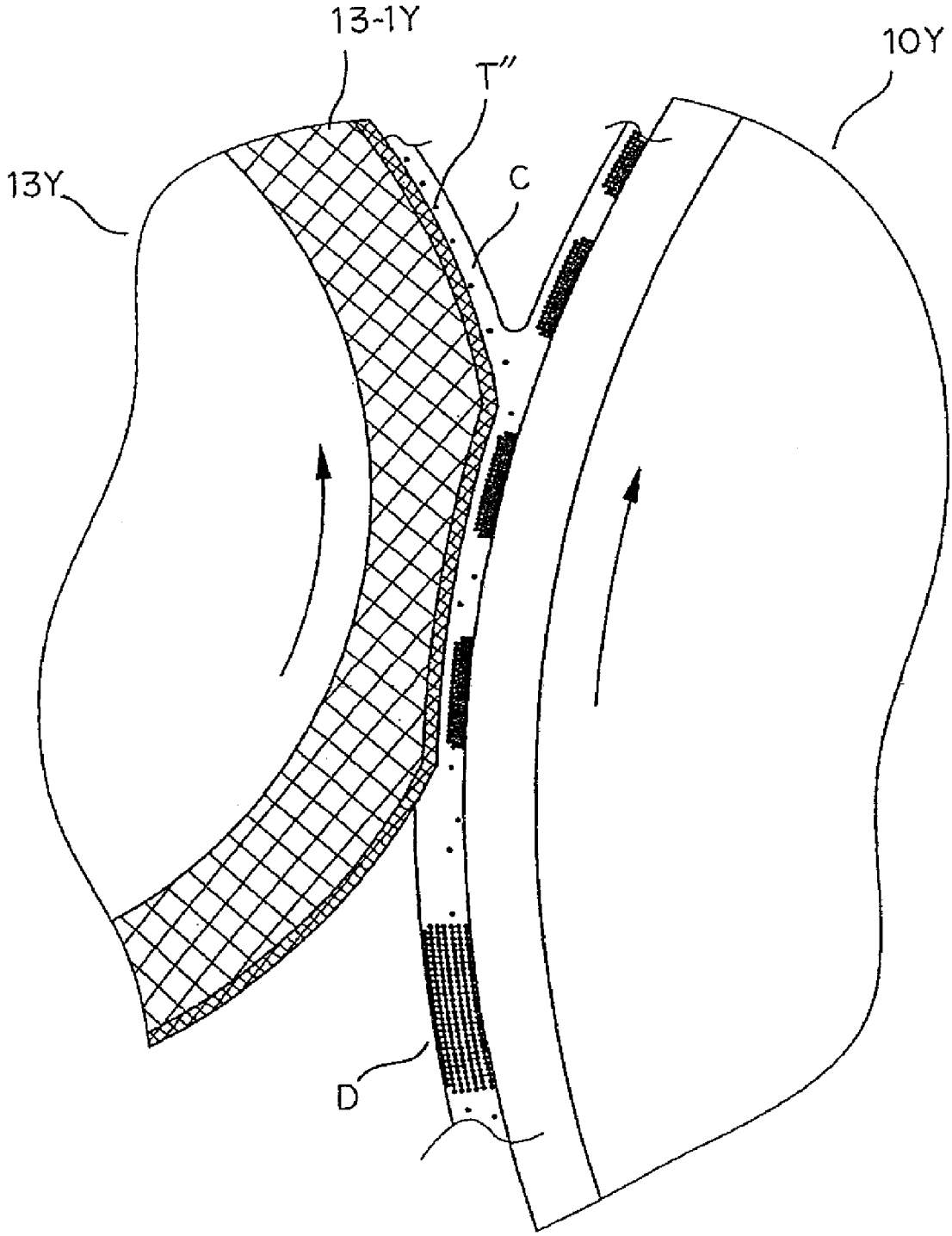
FIG. 5 is an illustration for explaining squeezing function by an image carrier squeezing roller 13Y.
Figure 6:
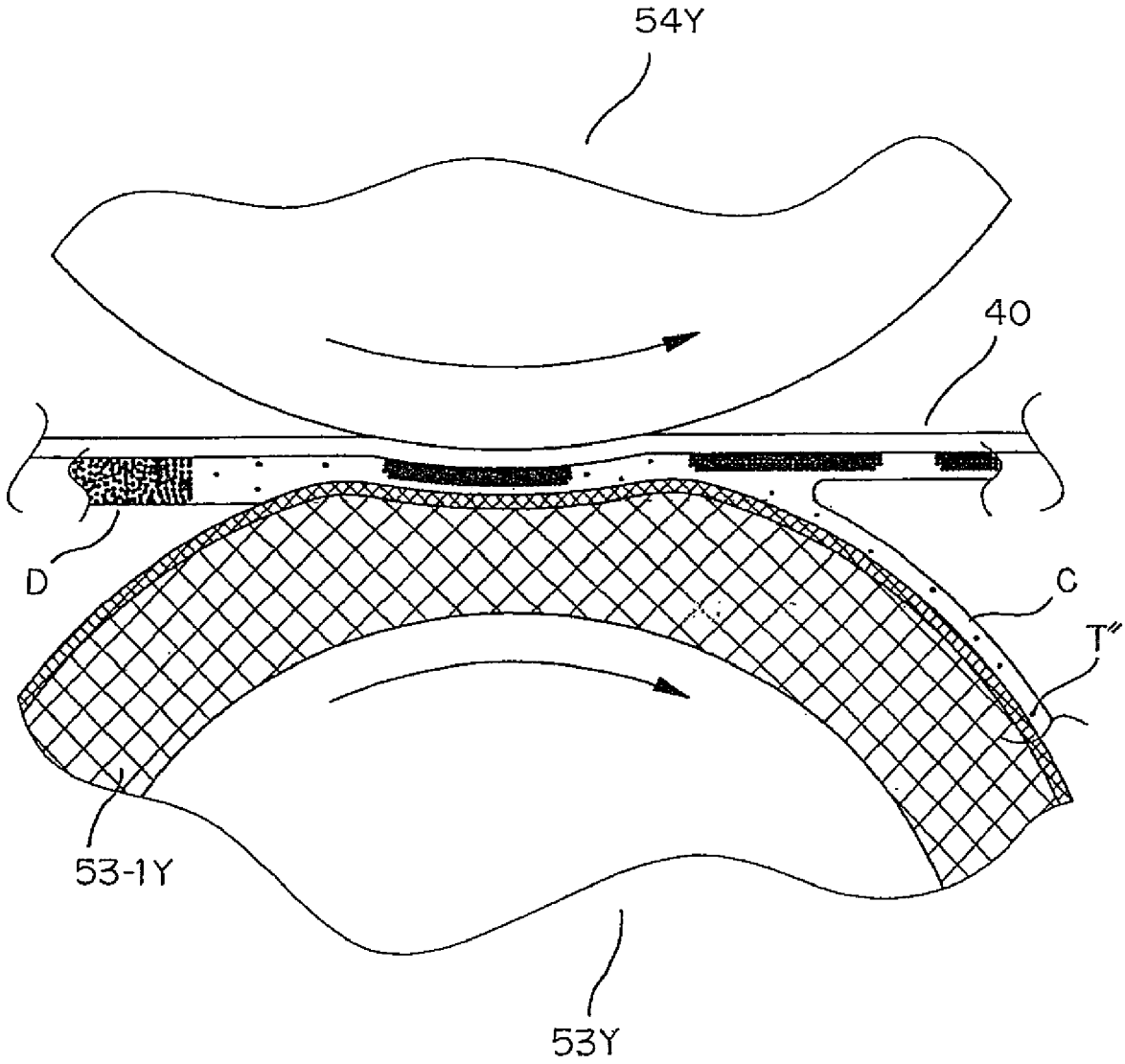
FIG. 6 is an illustration for explaining squeezing function by an intermediate transfer member squeezing device 52Y.

Hereinafter, the image forming sections and the developing units will be described. FIG. 2 is a sectional view showing main components composing the image forming section and the developing unit. FIG. 3 is an illustration for explaining compaction by a compaction roller 22Y, FIG. 4 is an illustration for explaining development by the development roller 20Y, FIG. 5 is an illustration for explaining squeezing function by an image carrier squeezing roller 13Y, and FIG. 6 is an illustration for explaining squeezing function by an intermediate transfer member squeezing device 52Y. Since the structures of the image forming sections and the structures of the development units for respective colors are the same, description will be made as regard to the image forming section and the development unit for yellow (Y).

Around the outer periphery of the image carrier 10Y in the order of the rotation direction, the image forming section comprises a latent image eraser 16Y, a cleaning device comprising an image carrier cleaning blade 17Y and a developer collecting portion 18Y, the charging roller 11Y, the exposure unit 12Y, the development roller 20Y of the developing unit 30Y, and a cleaning device comprising the image carrier squeezing roller 13Y and an image carrier squeezing roller cleaning blade 14Y and a developer collecting portion 30Y which are accessories of the image carrier squeezing roller 13Y. In the developing unit 30Y, a cleaning blade 21Y, a developer supplying roller 32Y composed of an anilox roll, and a compaction roller 22Y are arranged around the outer periphery of the development roller 20Y. A liquid developer agitating roller 34Y and the developer supplying roller 32Y are accommodated in the liquid developer container 31Y. The primary transfer roller 51Y of the primary transfer section is disposed on the intermediate transfer member 40 at a position facing the image carrier 10Y. Disposed on the intermediate transfer member 40 downstream of the primary transfer roller 51Y in the moving direction is the intermediate transfer member squeezing device 52Y comprising an intermediate transfer member squeezing roller 53Y, a back-up roller 54Y, an intermediate transfer member squeezing roller cleaning blade 55Y, and a developer collecting portion 56Y.

The image carrier 10Y is a photoconductive drum of a cylindrical member of which width is larger than the width about 320 mm of the development roller 20Y and which has a photoconductive layer on its outer periphery and is adapted to rotate, for example, in the clockwise direction as shown in FIG. 2. The photoconductive layer of the image carrier 10Y is composed of an organic image carrier or an amorphous silicon image carrier. The charging roller 11Y is located upstream of the nip portion between the image carrier 10Y and the development roller 20Y in the rotation direction of the image carrier 10Y A bias voltage having the same polarity as the charging polarity of the toner is applied from a power unit (not shown) to charge the image carrier 10Y The exposure unit 12Y irradiates laser beam to the image carrier 10Y, which is charged by the charging roller 11Y, at a position downstream of the charging roller 11Y in the rotation direction of the image carrier 10Y so as to form a latent image on the image carrier 10Y.

The developing unit 30Y comprises the compaction roller 22Y, the developer container 31Y in which liquid developer containing a toner of about 25% weight ratio dispersed in carrier is stored, the development roller 20Y for carrying the liquid developer, the developer supplying roller 32Y, a regulating blade 33Y, and an agitating roller 34Y which agitate the liquid developer to maintain uniform dispersed state and supply the liquid developer to the development roller 20Y, the compaction roller 22Y for making the liquid developer on the development roller 20Y to compaction state, and a development roller cleaning blade 21Y for cleaning the development roller 20Y.

The liquid developer stored in the developer container 31Y is a nonvolatile liquid developer which has high concentration and high viscosity and has nonvolatility at ambient temperatures, not a volatile liquid developer of a conventionally generally used type of which carrier is Isopar (trademark: Exxon) and which has low concentration (about 1-2 wt %) and low viscosity and has volatility at ambient temperatures. That is, the liquid developer of the invention is a liquid developer having high viscosity (30-10000 mPa·s) of which concentration of toner solid substance is about 25% and which is prepared by adding solid substance having mean particle diameter of 1 μm containing a colorant such as pigment dispersed in a thermoplastic resin to a liquid solvent such as an organic solvent, silicone oil, mineral oil, or cooking oil together with a dispersant.

The developer supplying roller 32Y is an anilox roller which is a cylindrical member having fine concavities which are uniformly formed by a spiral groove in the surface thereof in order to facilitate the carry of the developer on the surface. For example, the developer supplying roller 32Y rotates in the clockwise direction as shown in FIG. 2. As for the dimensions of the groove, the groove pitch is about 130 μm and the groove depth is about 30 μm. By the developer supplying roller 32Y, the liquid developer is supplied from the developer container 31Y to the development roller 20Y The agitating roller 34Y and the developer supplying roller 32Y may be disposed to be in contact with each other or to be spaced apart from each other.

The regulating blade 33Y comprises an elastic blade having a surface coated by an elastic body, a rubber portion made of urethane rubber or the like which is adapted to be in contact with the surface of the developer supplying roller 32Y, and a plate made of metal or the like for supporting the rubber portion. The regulating blade 33Y regulates and adjust the thickness and the amount of the liquid developer carried and conveyed by the developer supplying roller 32Y composed of an anilox roller, thereby adjusting the amount of the liquid developer to be supplied to the development roller 20Y The rotation direction of the developer supplying roller 32Y may not be the direction shown by an arrow in FIG. 2 and may be the opposite direction. In this case, the regulating blade 33Y is required to be positioned to correspond to the rotation direction of the developer supplying roller 32Y.

The development roller 20Y is a cylindrical member of about 320 mm in width and is adapted to rotate about its rotational axis in the counterclockwise direction as shown in FIG. 2. The development roller 20Y comprises an inner core made of a metal such as iron and an elastic layer such as polyurethane rubber, silicone rubber, NBR or the like which is formed on the outer periphery of the inner core. The development roller cleaning blade 21Y is made of rubber or the like and is disposed to be in contact with the surface of the development roller 20Y. The development roller cleaning blade 21Y is located downstream of the development nip portion where the development roller 20Y is in contact with the image carrier 10Y in the rotation direction of the development roller 20Y and is a member for scraping and removing liquid developer remaining on the development roller 20Y.

The compaction roller 22Y is a cylindrical member as an elastic roller having a surface coated by an elastic body 22-1Y similar to the development roller 20Y as shown in FIG. 3. The compaction roller 22Y comprises a metallic roller core and a conductive resin layer or rubber layer on the surface of the metallic roller core and is adapted to rotate, for example in the clockwise direction opposite to the rotation direction of the development roller 20Y as shown in FIG. 2. The compaction roller 22Y has a means of increasing the charging bias on the surface of the development roller 20Y so that an electric field is applied from the compaction roller 22Y to the developer conveyed by the development roller 20Y at a compaction position forming a nip where the compaction roller 22Y is in contact with the development roller 20Y as shown in FIG. 2 and FIG. 3. The electric field applying means of compaction may be corona discharge from a corona discharge device instead of the roller shown in FIG. 2.

By the compaction roller 22Y, as shown in FIG. 3, toner T uniformly dispersed in carrier C is moved to the development roller 20Y side and agglutinated so as to be in so-called compaction state T'. In addition, the compaction roller 22Y rotates in the direction shown by an arrow with carrying a part of the carrier C and a slight amount of remaining toner T" which is not made into the compaction state which are then scraped and removed by a compaction roller cleaning blade 23Y and join the developer in the reservoir 31Y for recycling. On the other hand, the developer D in the compaction state carried by the development roller 20Y develops a latent image on the image carrier 10Y by application of desired electric field at the development nip portion where the development roller 20Y is in contact with the image carrier 10Y as shown in FIG. 4. The developer D remaining after development is scraped and removed by the development roller cleaning blade 21Y and joints the developer in the reservoir 31Y for recycling. It should be noted that the joined carrier and the toner are of single color not mixed color.

The image carrier squeezing device is disposed to face the image carrier 10Y at a position downstream of the development roller 20Y to collect excess developer of the developed toner image on the image carrier 10Y and comprises, as shown in FIG. 2 and FIG. 5, an image carrier squeezing roller 13Y which is composed of an elastic roller member having a surface coated by an elastic body 13-1Y and which is adapted to rotate with being in contact with the image carrier 10Y, and a cleaning blade 14Y which is pressed against the image carrier squeezing roller 13Y to clean the surface of the image carrier squeezing roller 13Y. The image carrier squeezing device has a function of collecting excess carrier C and undesired fog toner T" from the developer D developed on the image carrier 10Y so as to increase the ratio of toner particles in the developed image. The collecting capacity for collecting the excess carrier C can be set to a desired level by setting the rotation direction of the image carrier squeezing roller 13Y and the circumferential velocity differential of the surface of the image carrier squeezing roller 13Y relative to the circumferential velocity of the surface of the image carrier 10Y. By setting the rotation direction of the image carrier squeezing roller 13Y to be opposite to the rotational direction of the image carrier 10Y, the collecting capacity is increased. By setting the circumferential velocity differential to be larger, the collecting capacity is increased. Synergetic effect may also be possible.

In this embodiment, the image carrier squeezing roller 13Y is rotated at substantially the same circumferential velocity as the image carrier 10Y so as to collect the excess carrier C of about 5-10% weight ratio from the developer D developed on the image carrier 10Y as shown in FIG. 5. This arrangement reduces the rotation driving load of both the image carrier 10Y and the image carrier squeezing roller 13Y and restrains disturbance to the developed toner image on the image carrier 10Y. The excess carrier C and the undesired fog toner T"collected by the image carrier squeezing roller 13Y are collected from the image carrier squeezing roller 13Y and pooled in the developer collecting portion 15Y by the action of the cleaning blade 14Y It should be noted that the excess carrier C and the fog toner T" never be of mixed color because these are collected from the exclusive and separate image carrier 10Y.

At the primary transfer section 50Y, the developed image on the image carrier 10Y is transferred to the intermediate transfer member 40 by the primary transfer roller 51Y. The image carrier 10Y and the intermediate transfer member 40 are adapted to move at the same velocity, thereby reducing the driving load for rotation and movement and restraining disturbance to the developed toner image on the image carrier 10Y. Color mixing phenomenon does not occur at the primary transfer section 50Y for the first color because of the first time primary transfer. However, as for the second color or later, another toner image is transferred to and superposed onto the toner image portion which was primarily transferred so that so-called reverse transfer phenomenon that toner is transferred from the intermediate transfer member 40 to the image carrier 10(M, C, K) occurs and the color mixing phenomenon occurs between reverse-transferred toner and remaining toner after transfer. The reverse-transferred toner and the remaining toner after transfer are carried and conveyed by the image carrier 10(M, C, K) together with the excess carrier, and are collected from the image carrier by the action of the cleaning blade 17(M, C, K) and are pooled.

The intermediate transfer member squeezing device 52Y is disposed downstream of the primary transfer section 50Y and conducts a process of removing excess carrier liquid from the intermediate transfer member 40 so as to increase the ratio of toner particles in the developed image. The intermediate transfer member squeezing device 52Y is a means for further removing excess carrier from the intermediate transfer member 40 when the amount of carrier in the developer (toner dispersed in carrier) transferred to the intermediate transfer member 40 at the primary transfer section 50Y is too much to satisfy 40%-60% as desired level of substantial toner weight ratio of the liquid developer in suitably dispersed state for exhibiting the preferable secondary transfer function and fixing function at the time of immediately before the fixing process (not shown) after the final secondary transfer to a sheet material. Similar to the image carrier squeezing device, the intermediate transfer member squeezing device 52Y comprises an intermediate transfer member squeezing roller 53Y which is composed of an elastic roller member having a surface coated by an elastic body and which is adapted to rotate with being in contact with the intermediate transfer member 40, a backup roller 54Y which is disposed to face the intermediate transfer member squeezing roller 53Y with the intermediate transfer member 40 therebetween, a cleaning blade 55Y which is pressed against the intermediate transfer member squeezing roller 53Y to clean the surface of the intermediate transfer member squeezing roller 53Y, and a developer collecting portion 56Y. As shown in FIG. 6, the intermediate transfer member squeezing device 52Y has a function of collecting excess carrier C and undesired fog toner T" from the developer D primarily transferred to the intermediate transfer member 40. The developer collecting portion 56Y functions also as a collecting mechanism for carrier liquid collected by the image carrier squeezing roller cleaning blade 14M for magenta which is arranged downstream.

The collecting capacity for collecting the excess carrier can be set to a desired level by setting the rotation direction of the intermediate transfer member squeezing roller 53Y and the circumferential velocity differential of the surface of the intermediate transfer member squeezing roller 53Y relative to the velocity of the movement of the intermediate transfer member 40. By setting the rotation direction of the intermediate transfer member squeezing roller 53Y to be opposite to the direction of the intermediate transfer member 40, the collecting capacity is increased. By setting the circumferential velocity differential to be larger, the collecting capacity is increased. Synergetic effect may also be possible. In this embodiment, the intermediate transfer member squeezing roller 53Y is rotated at substantially the same circumferential velocity as the velocity of the intermediate transfer member 40 so as to collect excess carrier and fog toner of about 5-10% weight ratio from the developer primarily transferred to the intermediate transfer member 40. This arrangement reduces the rotation driving load of both the intermediate transfer member 40 and the intermediate transfer member squeezing roller 53Y and restrains disturbance to the toner image on the intermediate transfer member 40.

Color mixing phenomenon does not occur at the intermediate transfer member squeezing section for the first color because of the first time intermediate transfer member squeezing. However, as for the second color or later, another toner image is transferred to and superposed onto the toner image portion which was primarily transferred so that the toner transferred from the intermediate transfer member 40 to the intermediate transfer squeezing roller 53Y is of mixed color and is carried and conveyed by the intermediate transfer member squeezing roller 53Y together with the excess carrier and collected from the intermediate transfer roller squeezing roller 53Y by the action of the cleaning blade. When the squeezing capacity by the image carrier 10Y at the primary transfer section upstream of the intermediate transfer member squeezing process and the squeezing capacity by the intermediate transfer member squeezing roller 53Y are sufficient, the intermediate transfer member squeezing device downstream of each primary transfer section is not always needed.

Hereinafter, the actions of the image forming apparatus of the present invention will be described. In like manner, description will be made as regard to the image forming section and the developing unit 30Y for yellow as an example of the four image forming sections and developing units.

In the developer container 31Y, the toner particles in the liquid developer have a positive charge. The liquid developer is agitated by the agitating roller 34Y and is picked up from the developer container 31Y by the rotation of the developer supplying roller 32Y. In the image forming apparatus using a liquid developer containing a carrier and a toner dispersed in the carrier of this embodiment, a liquid developer in which 25% toner is dispersed in 75% carrier by substantial weight ratio is employed. At a stage as the final stage just before the secondary transfer to a sheet medium and the fixing process (not shown) after various image forming processes, the liquid developer preferably has a substantial toner weight ratio of from 40% to 60% in order to exhibit desirable secondary transfer function and fixing function. The developer initially stored in the developer container 31Y preferably has a substantial toner weight ratio of about 25%. The consumption rate of toner component is high in case of development with high image duty in the development to the image carrier 10Y, while the consumption rate of toner component is low in case of development with low image duty. That is, the toner weight ratio in the developer stored in the developer container 31Y is changed according to the development to the image carrier 10Y so that it is required to always monitor the changes and to control the developer to be maintained to have a substantial toner weight ratio of about 25%.

In this embodiment, a transmissive photosensor for detecting a dispersing weight ratio of toner or a torque detecting means for detecting agitating torque for agitating the developer and a reflective photosensor for detecting the surface of the developer in the developer container 31Y are disposed in the developer container 31Y, but not shown in illustrations. When the dispersing weight ratio of toner in a predetermined amount of developer becomes low, a predetermined amount of a high-concentration developer of which toner weight ratio is in a range of about 35% to 55% is replenished from a developer cartridge. On the other hand, when the dispersing weight ratio of toner becomes high, a predetermined amount of the carrier is replenished from a carrier cartridge. In this manner, the substantial toner weight ratio is controlled to be about 25% and the developer is agitated to be uniformly dispersed within the developer container 31Y.

The regulating blade 33Y is in contact with the surface of the developer supplying roller 32Y to scrape excess liquid developer with leaving liquid developer within the groove for concavities of anilox pattern formed in the surface of the developer supplying roller 32Y, thereby regulating the amount of liquid developer to be supplied to the development roller 20Y. By this regulation, the thickness of the liquid developer applied on the development roller 20Y is quantified to be about 6 μm. The liquid developer scraped by the regulating blade 33Y is dropped and returned to the developer container 31Y because of gravity. The liquid developer not scraped by the regulating blade 33Y is accommodated in the groove for the concavities formed in the surface of the developer supplying roller 32Y and is applied to the surface of the development roller 20Y by pressing the developer supplying roller 32Y against the development roller 20Y.

The development roller 20Y on which the liquid developer is applied by the developer supplying roller 32Y comes in contact with the compaction roller 22Y at downstream of the nip portion with the developer supplying roller 32Y. A bias voltage about +400V is applied to the development roller 20Y and a bias voltage of the same polarity as the charging polarity of the toner which is higher than that applied to the development roller 20Y is applied to the compaction roller 22Y For example, a bias voltage about +600V is applied to the compaction roller 22Y The toner particles in the liquid developer on the development roller 20Y move to the development roller 20Y side when passing the nip portion with the compaction roller 22Y as shown in FIG. 3. Accordingly, the toner particles are joined gradually and are formed into a layer so that the toner particles are quickly transferred from the development roller 20Y to the image carrier 10Y during the development at the image carrier 10Y, thereby improving the image concentration.

The image carrier 10Y is made of amorphous silicon. After the surface of the image carrier 10Y is charged to have +600V by the charging roller 11Y at upstream of the nip portion with the development roller 20Y, a latent image is formed on the image carrier 10Y by the exposure unit 12Y such that the electric potential of image portion is +25V. At the development nip portion formed between the development roller 20Y and the image carrier 10Y, as shown in FIG. 4, the toner particles T are selectively transferred to imaging portion on the image carrier 10Y according to an electric field generated by a bias voltage of +400V applied to the development roller 20Y and the latent image (imaging portion +25V, non-imaging portion +600V) on the image carrier 10Y, thereby forming a toner image on the image carrier 10Y. Since the carrier liquid C is not affected by the electric filed, the carrier liquid C is separated at the exit of the development nip portion between the development roller 20Y and the image carrier 10Y so that the carrier liquid adheres to both the development roller 20Y and the image carrier 10Y as shown in FIG. 4. After the development nip portion, the image carrier 10Y pass the image carrier squeezing roller 13Y where excess carrier liquid C is removed so as to increase the ratio of toner particles in the developed image as shown in FIG. 5.

The image carrier Y passes the nip portion with the intermediate transfer member 40 at the primary transfer section 50Y where the developed toner image is primarily transferred to the intermediate transfer member 40. By applying a voltage about −200V of the polarity opposite to the charging polarity of the toner particles to the primary transfer roller 51Y, the toner particles are primarily transferred from the image carrier 10Y to the intermediate transfer member 40 and only the carrier liquid remains on the image carrier 10Y. At downstream side of the primary transfer section in the rotation direction of the image carrier 10Y, the electrostatic latent image on the image carrier 10Y after the primary transfer is removed by the latent image eraser 16Y composed of a lamp or the like and the carrier liquid remaining on the image carrier 10Y is scraped by the image carrier cleaning blade 17Y and is collected by the developer collecting portion 18Y.

The toner image primarily transferred to the intermediate transfer member 40 at the primary transfer section SOY passes the intermediate transfer member squeezing device 52Y to scrape excess carrier from the toner image on the intermediate transfer member 40. A voltage of +400V is applied to the intermediate transfer squeezing roller 53Y of the intermediate transfer member squeezing device 52Y and a voltage of +200V is applied to the intermediate transfer member squeezing backup roller 54Y, such an electric field as to press the toner particles to the intermediate transfer member 40 side is generated. Accordingly, as shown in FIG. 6, the carrier liquid which is not affected by the electric field is separated between the intermediate transfer member 40 and the intermediate transfer member squeezing roller 53Y so that collected by the intermediate transfer roller 53Y is only the separated carrier liquid, not toner particles.

Then, the toner image on the intermediate transfer member 40 moves to the secondary transfer unit 60 and enters into the nip portion between the intermediate transfer member 40 and the secondary transfer roller 61. The nip width is set to 3 mm. At the secondary transfer unit 60, a voltage of −1200V is applied to the secondary transfer roller 61 and a voltage of +200V is applied to the belt driving roller 41, whereby the toner image on the intermediate transfer member 40 is transferred to a recording medium such as a paper.

After passing the secondary transfer unit 60, the intermediate transfer member 40 moves to a portion winding the tension roller 42 where toner particles are pressed to the intermediate transfer member 40 side by the intermediate transfer member compaction roller 43 and the surface of the intermediate transfer member 40 is cleaned by the intermediate transfer member cleaning blade 46. Then, the intermediate transfer member 40 is again headed to the primary transfer section 50.

Hereinafter, the squeezing function of the secondary transfer roller 61 will be described. In synchronization with the arrival of the toner image of mixed color on the intermediate transfer member 40 to the secondary transfer section, the sheet medium is fed so that the toner image is secondarily transferred to the sheet medium. By conveying the toner image on the sheet medium to the fixing process (not shown), final image formation on the sheet medium is finished. When a sheet feeding trouble such as jam arises, the toner image comes in contact with the secondary transfer roller 61 without sheet medium therebetween and is thus transferred to the secondary transfer roller 61, thus causing contamination of the reverse side of sheet medium. The secondary transfer roller 61 of this embodiment is a means for allowing the secondary transfer to a sheet medium even having an uneven surface because of fibers so as to improve the secondary transfer characteristics and is composed of an elastic roller having a surface coated by an elastic body for the same purpose of the elastic belt employed as the intermediate transfer member 40 which carries toner images sequentially primarily transferred from a plurality of photoconductors and secondarily transfers the toner images to the sheet medium collectively. The secondary transfer roller cleaning blade 62 is a means for removing the developer (toner particles dispersed in carrier) transferred to the secondary transfer roller 61. The secondary transfer roller cleaning blade 62 collects the developer from the secondary roller 61 to pool the developer. It should be noted that the pooled developer is of mixed color and may contain foreign matter such as powder of paper.

Hereinafter, the cleaning device for the intermediate transfer member 40 will be described. When a sheet feeding trouble such as jam arises, the toner image is not completely transferred to the secondary transfer roller 61 and a part of the toner image remains on the intermediate transfer member 40. Further, even in the normal secondary transfer process, not 100% of the toner image on the intermediate transfer member 40 is secondarily transferred to the sheet medium so that residual toner of several percent of the toner image after secondary transfer is generated. Such undesired toner images is collected and pooled by the intermediate transfer member compaction roller 43 which is disposed in contact with the intermediate transfer member 40, the intermediate transfer member cleaning blade 46 which is disposed downstream of the intermediate transfer member compaction roller 43 in the moving direction of the intermediate transfer member 40, and the developer collecting portion 47 as the preparation for next image formation. During this, such a bias voltage as to press the residual toner on the intermediate transfer member 40 against the intermediate transfer member 40 is applied to the intermediate transfer member compaction roller 43.

Figure 7:
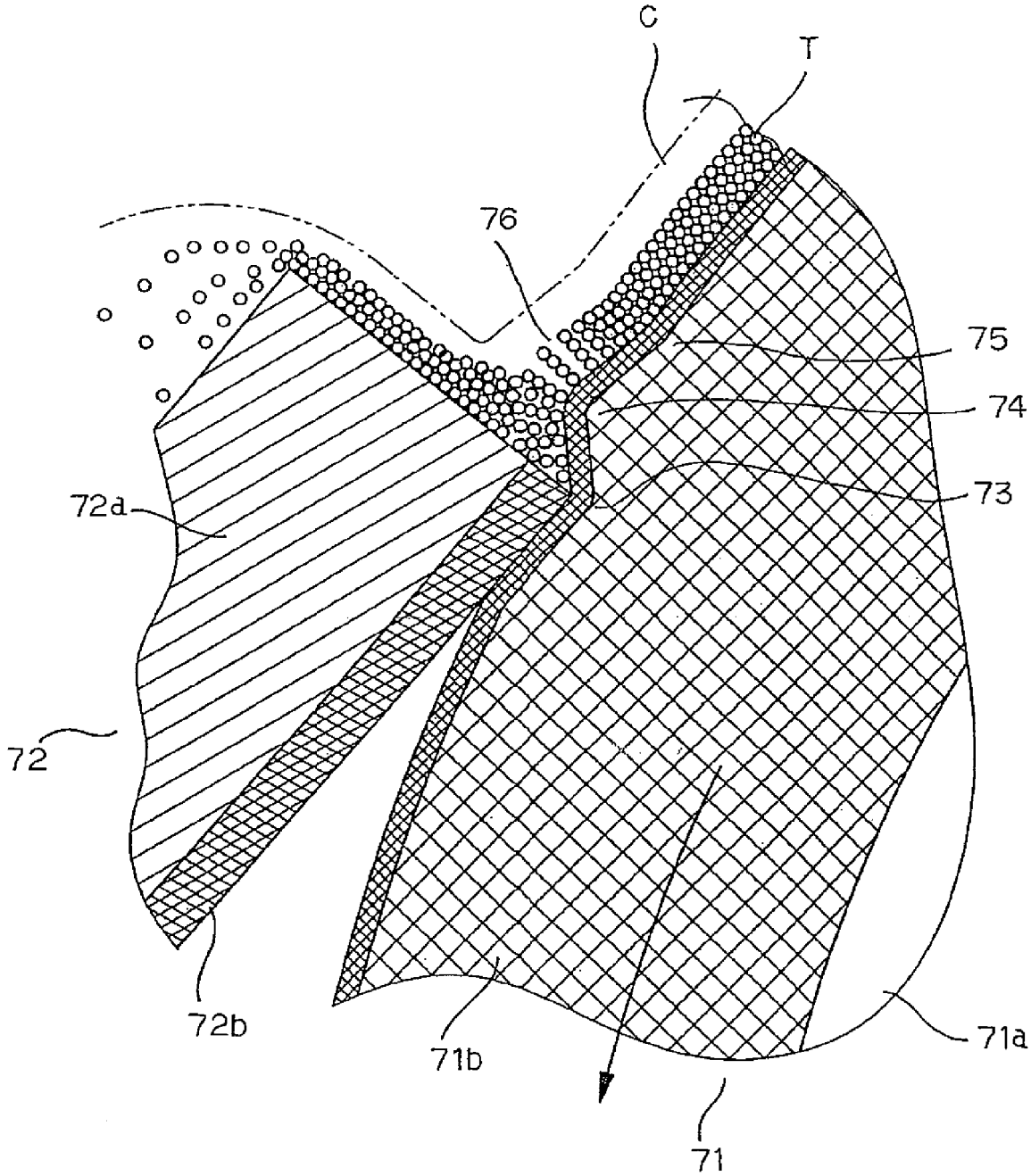
FIG. 7 is an enlarged view for explaining the cleaning mechanism of an elastic roller member.
Figure 8:
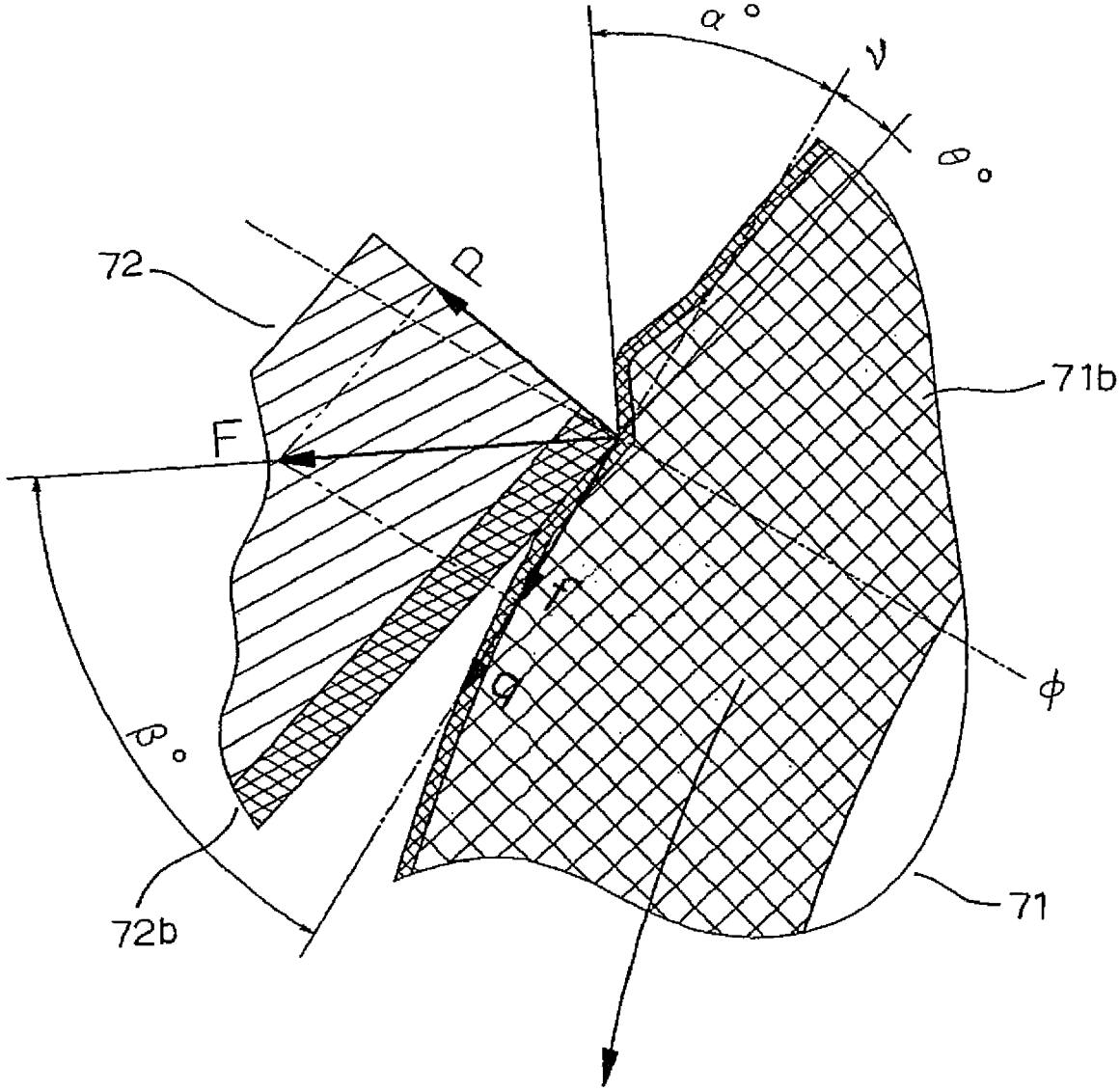
FIG. 8 is an enlarged view for explaining the angle of a blade, the pressing force relation, and the mechanism at a portion to be cleaned.

Hereinafter, the cleaning mechanism of an elastic roller member will be described. FIG. 7 is an enlarged view for explaining the cleaning mechanism of the elastic roller member, and FIG. 8 is an enlarged view for explaining the angle of a blade, the pressing force relation, and the mechanism at a portion to be cleaned. Numeral 71 designates the elastic roller, 71*a* designates a roller core, 71*b* designates an elastic body, 72 designates a cleaning blade, 72*a* designates a blade base, and 72*b* designates a blade outer layer.

Among the cleaning conditions for cleaning developer by the elastic rollers disposed at the respective positions in this embodiment, the cleaning condition for cleaning the development roller 20Y is most severe because the developer on the development roller 20Y to be cleaned is in the so-called compaction state in which toner particles are moved and agglutinated to the development roller 20Y side by applying an electric filed from the compaction roller 22Y or a corona discharger to the development roller 20Y carrying toner particles uniformly dispersed in carrier.

On the other hand, the mean particle diameter (number mean particle size) of toner particles is about 1 μm, while the surface roughness Rz of the elastic roller is about 2 μm, that is, rougher than the mean particle diameter of the toner particles. Accordingly, when toner particles individually exist in isolation from each other on the surface of the elastic roller, it is difficult to clean the individual toner particles. However, as the plural toner particles are agglutinated due to compaction, the cleaning is easy according to the cleaning method of the present invention.

Though description will now be made as regard to cleaning of developer in the compaction state on the development roller 20Y having a surface coated by elastic body as an example, the works and effects are applied to cleaning of developer on the other elastic rollers disposed at the other positions.

In FIG. 7, as the elastic body 71*b* of the elastic roller 71 is pressed by a tip edge of the cleaning blade 72, the elastic body 71*b* is concaved 73 at the pressed portion as illustrated and a concaved volume is shifted to form a convex 74 projecting from the circle gauge diameter upstream in the rotation direction of the elastic roller 71. As the elastic roller 71 is rotated in the direction shown by an arrow relative to the cleaning blade 72 which is fixed, toner particles T of developer on the surface of the elastic body 71*b* are subjected to compressive stress in the circumferential direction at a transition area 75 from the circular gauge diameter to the convex 74 of the elastic body 71*b* and toner particles T becomes into the separation state in the circumferential direction because of expansion of the elastic body 71*b* at a position about the top of the convex. Therefore, the adhering force of the toner particles T relative to the surface of the elastic body 71*b* is reduced by the compressive stress and separation in the circumferential direction. The toner particles T become in the state easily released from the surface of the elastic body 71*b* when the toner particles T enter the portion where the cleaning blade 72 is in contact with and pressed against the elastic body 71*b*, thereby exhibiting excellent cleaning function.

In FIG. 8, the cleaning blade 72 is pressed with contact pressure P (the direction of P in the drawing is a direction of reaction force from the elastic body 71*b* against the contact pressure) against the elastic body 71*b* of the elastic roller 71 so as to elastically deform the elastic body 71*b* according to the aforementioned mechanism as shown in the drawing. The elastic deforming configuration of the elastic body 71*b* is defined by the relation between the elastic hardness of the elastic body 71*b* and the hardness of the cleaning blade 72 and the attitude at the contact.

Assuming that an angle of a contact face of the cleaning blade 72 relative to a perpendicular line (a line parallel to a tangential line of the elastic roller 71) ν perpendicular to a generating line (a center line passing the rotational axis) Ø of the elastic roller 71 at the contact point where the tip end of the cleaning blade 72 is pressed against and in contact with the elastic roller 71 is θ and an angle of a rising contour of a deformed portion of the elastic body 71*b* which is deformed by the pressure of the cleaning blade 72 against the elastic roller 71 relative to the perpendicular line ν is a, the angle a increases in proportion to tenderness of the elastic hardness of tie elastic roller 71 while the angle a decreases in proportion to hardness of the elastic hardness of the elastic roller 71 so that a=0 when the elastic roller 71 is a rigid roller. Since the amount of elastic deformation of the elastic body 71*b* increases in proportion to tenderness of the elastic hardness of the elastic roller 71, the compressive stress and separation in the circumferential direction applied to the developer on the surface of the elastic roller 71 increase, thereby reducing the adhering force of the toner particles to the surface of the elastic body 71*b* and thus facilitating the separation of the toner particles from the surface of the elastic body 71*b*. That is, the decrease in the elastic hardness enables good cleaning function.

On the other hand, the cleaning blade 72 may be a rigid blade or an elastic blade. To obtain a desired contact pressure, however, another mechanism for applying a desired contact pressure is required in case that the cleaning blade is a rigid blade. In case that the cleaning blade is an elastic blade, the contact pressure can be adjusted according to the deflection amount of the cleaning blade 72 so that simple structure is allowed. In this embodiment, the elastic blade having simple structure is employed as the cleaning blade 72. Basically, the hardness of the cleaning blade 72 is higher than the hardness of the elastic body of the elastic roller so that the elastic body 71*b* of the elastic roller 71 is primarily elastically deformed according to the magnitude of the contact pressure P.

In FIG. 8, as the elastic roller 71 is rotated in the direction shown by an arrow with the elastic body 71*b* of the elastic roller 71 being deformed according to the magnitude of the contact pressure P, a force F acts toward the cleaning blade 72 in a direction perpendicular to the rising contour of the elastic deformed portion of the elastic body 71*b*. Rotational loads to the elastic roller 71 due to P and F are f and q acting in a direction perpendicular to the generating line Ø. Here, f=F cos β, β=90·a, and q is a force acting in a direction of rotational load due to frictional force between the elastic body and the cleaning blade 72 at the contact point when the elastic roller 71 is rotated with the cleaning blade 72 being in contact with the elastic body 71*b* of the elastic roller 71 with some pressure, that is, a direction perpendicular to the generating line Ø at the contact point. The acting direction of force F is a direction perpendicular to the rising contour of the elastic deformed portion of the elastic member 71*b*. The magnitude of this force depends on the frictional force of the elastic body and the cleaning blade 72 similar to the force q.

The linear pressure of the cleaning blade 72 being pressed against the elastic member 71*b* of the elastic roller 71 is preferably in a range between 10 gf/cm and 80 gf/cm because defective cleaning such as slippage loss may be caused when the linear pressure is 10 gf/cm or less and the driving torque is too large when the linear pressure is 80 gf/cm or more. The preferable linear pressure is 40 gf/cm.

As Example 1, the elastic body 71*b* is made of a rubber material of which rubber hardness can be easily controlled such as polyurethane rubber, urethane rubber, silicone rubber, or NBR. By setting the rubber hardness to JIS A of from 30 to 50 degrees, a preferable elastic deformation is obtained, thus exhibiting excellent cleaning function.

As Example 2, the elastic body 71*b* is made of foamed material in which a rubber material such as polyurethane rubber, silicone rubber or NBR is foamed at a desired foaming ratio. By setting the hardness of the foamed material to ASKER C of from 30 to 50 degrees (corresponding to JIS A of from 10 to 20 degrees), further preferable elastic deformation is obtained, thereby exhibiting further excellent cleaning function. As a means for reducing the friction coefficient of the rubber surface, an outer layer is made of a resin of fluorine series such as PFA, PTFA, or the like or a resin of nylon series having a friction coefficient smaller than that of the rubber material, that is, the foamed cell is coated or covered by a tube having a thickness of from 3 to 10 μm made of the aforementioned resin. This reduces the frictional force generated at the portion pressed by the cleaning blade 72 and also reduces the adhering force of toner particles carried by the surface of the elastic roller, thereby exhibiting excellent cleaning function. The hardness of the outer layer covered by the tube is preferably set to ASKER C of from 40 to 60 degrees (corresponding to JIS A of from 10 to 25 degrees).

As Example 3, the elastic body 71*b* is made of a rubber material of which rubber hardness can be easily controlled such as polyurethane rubber, urethane rubber, silicone rubber, or NBR. By setting the rubber hardness to JIS A of from 30 to 50 degrees, a preferable elastic deformation is obtained, thus exhibiting excellent cleaning function. As a means for reducing the friction coefficient of the rubber surface, the rubber surface is coated with a layer having a thickness of from 3 to 5 μm or a tube having a thickness of from 3 to 10 μm made of a resin of fluorine series such as PFA, PTFA, or the like or a resin of nylon series having a friction coefficient smaller than that of the rubber material. This reduces the frictional force generated at the portion pressed by the cleaning blade 72 and also reduces the adhering force of toner particles carried by the surface of the elastic roller, thereby exhibiting excellent cleaning function. The hardness of the outer layer which is coated by the layer or covered by the tube is preferably set to JIS A of from 35 to 55 degrees.

As Example 4, the elastic body 71*b* is formed to have a foamed portion having lower density and a non-formed portion (a solid outer layer portion) having higher density which is made of the same material as the foamed portion, such that the nearer to the outer surface of the roller, the higher the density is. Since the foamed portion and the solid outer layer portion are made of the same material and are thus continuous, the elastic body 71*b* has no substantial boundary between the foamed portion and the solid outer layer portion. The foam material is suitably a flexible foam material. As the foam material, polyurethane foam, polystyrene foam, polyethylene foam, elastomer foam, rubber foam or the like can be employed. By setting the hardness of the solid outer layer portion to ASKER C of from 30 to 50 degrees (corresponding to JIS A of 10 to 20 degrees), a preferable elastic deformation is obtained. As the manufacturing method of the foam material, the reaction injection molding method may be employed and the gas foaming method, the foaming agent decomposition method, the solvent gas scattering method, the chemical reaction method, the sintering method, or the elution method may also be employed. Description of JP-A-5-46020 may be referred for more details.

As the means for reducing the rotational load of the elastic roller, measurement on the cleaning blade 72 side will be described.

As Example 1, the cleaning blade 72 as the elastic cleaning blade is made of polyurethane rubber and the rubber hardness thereof is set to JIS A of from 60 to 100 degrees. Accordingly, the cleaning blade 72 is preferably elastically deformed so as to obtain a desirable contact pressure. That is, by setting the hardness of the cleaning blade 72 to be higher than the hardness of the elastic body 71*b* of the elastic roller 71 mentioned above, the elastic body 71*b* of the elastic roller 71 is primarily deformed according to the contact pressure. As the means for reducing the friction coefficient of the rubber surface, a resin of fluorine series such as PFA, PTFA, or the like of which friction coefficient is smaller than that of the rubber material is fixed to the surface of the cleaning blade 72 which is pressed against the elastic body 71*b*. However, if the surface of the elastic roller 71 is treated with the measurement for reducing friction, the measurement on the cleaning blade side is not necessary. The desired contact pressure can be obtained according to the thickness of the cleaning blade 72 even if the rubber hardness of the cleaning blade 72 is JIS A 60 degrees or less. However, in this case, it is not preferable because micro vibration or chatter occurs at the press contact portion.

As Example 2, the cleaning blade 72 as a rigid cleaning blade is formed by a stainless steel plate and gives a desired contact pressure by a pressing means such as a spring (not shown). The hardness of the cleaning blade 72 is set to be higher than the hardness of the elastic body of the elastic roller 71 mentioned above so that the elastic body 71*b* of the elastic roller 71 is primarily deformed according to the contact pressure. As the means for reducing the friction coefficient of the stainless steel plate surface, a resin of fluorine series such as PFA, PTFA, or the like of which friction coefficient is smaller than that of the stainless steel plate material is fixed to the surface of the cleaning blade 72 which is pressed against the elastic body. However, if the surface of the elastic roller 71 is treated with the measurement for reducing friction, the measurement on the cleaning blade side is not necessary.

The angles θ and a are set as follows. The angle θ is set in such a manner that the tip end of the cleaning blade 72 is dominantly pressed against the elastic body 71*b* to have the largest contact pressure at the tip end. Concretely, by setting the angle θ to a range of from 6° to 30°, preferable developer cleaning characteristics can be obtained. If the angle θ is smaller than 6°, the largest contact pressure is generated at a position not the tip end, i.e., the cleaning blade becomes to so-called creeping state, so that the contact pressure at the tip end should be poor and the preferable cleaning characteristics can not be obtained. On the other hand, if the angle θ exceeds 30°, the contact pressure at the tip end of the cleaning blade 72 is focused extremely so that the elastic body 71*b* is deformed into a wedge shape. In this case, it is not preferable because the rotational load of the elastic roller 71 becomes too large.

Figure 9:
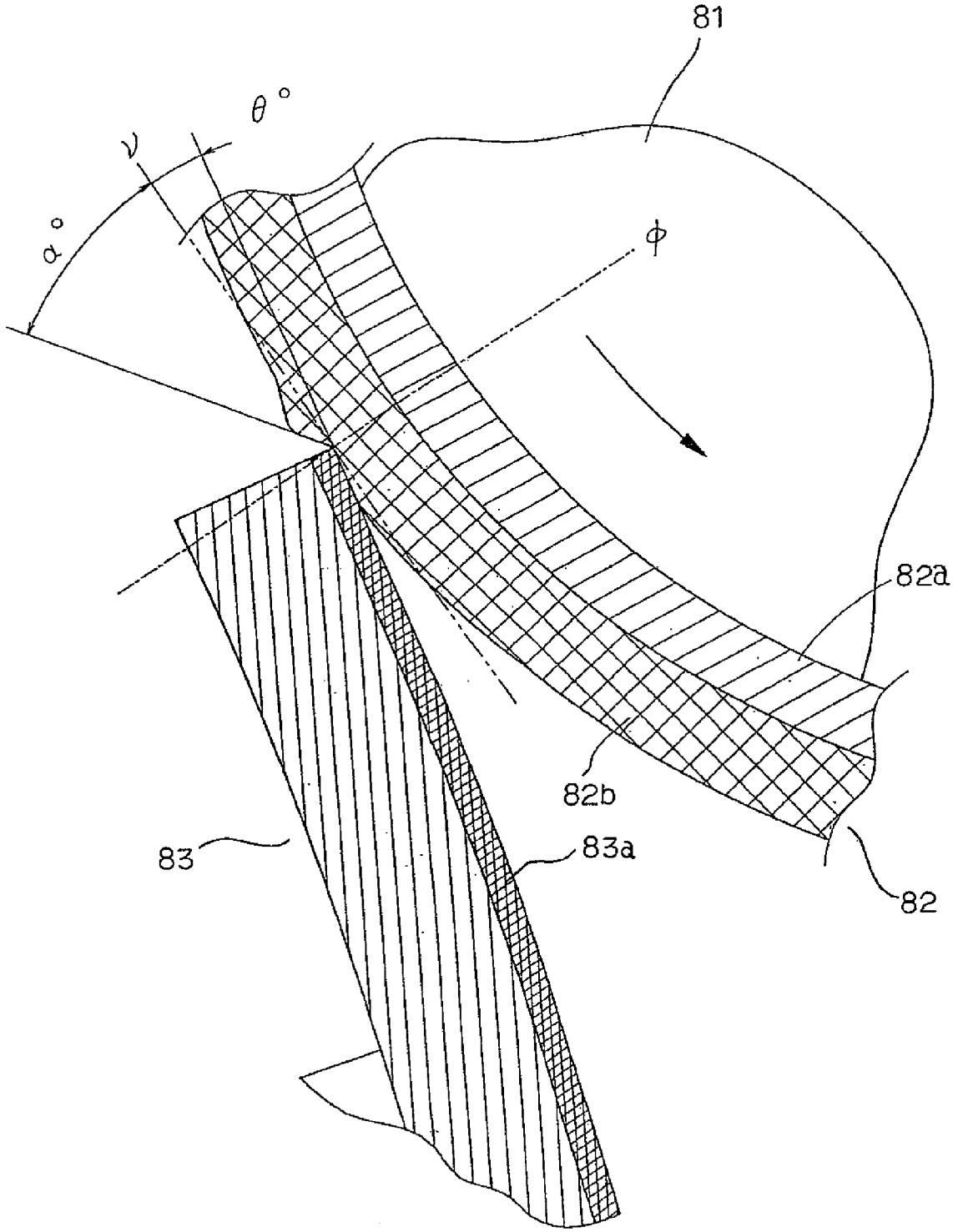
FIG. 9 is an enlarged view for explaining a cleaning mechanism conducted at a winding area of a belt.
Figure 10:
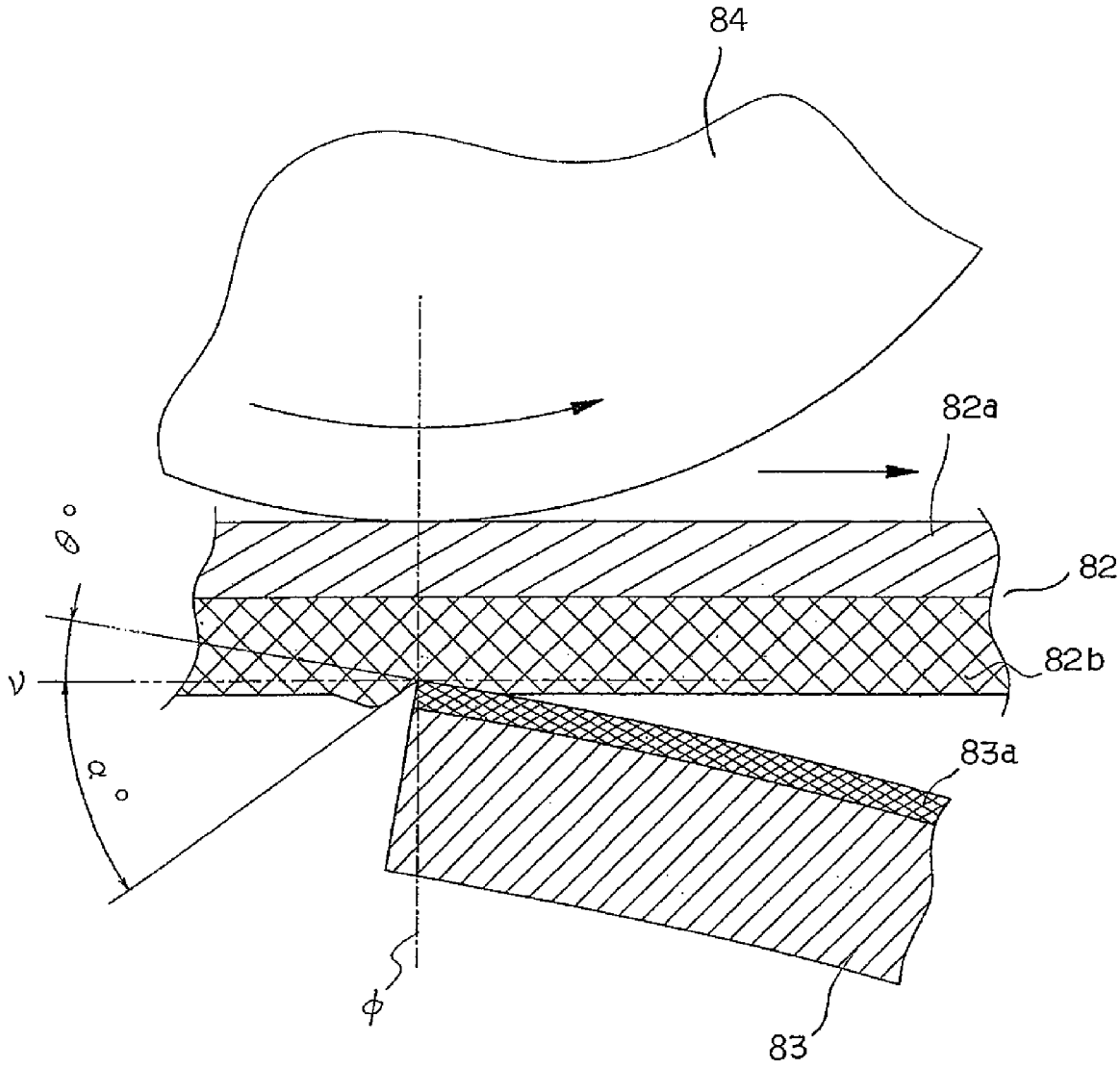
FIG. 10 is an enlarged view for explaining a cleaning mechanism conducted at a linear movement area of the belt.

The angle a increases in proportion to tenderness of the elastic hardness of the elastic roller 71. In other words, the angle a decreases in proportion to hardness of the elastic hardness of the elastic roller 71 so that a=0 when the elastic roller 71 is a rigid roller. That is, by relating the hardness of the elastic roller 71 and the contacting attitude of the cleaning blade 72 to achieve a>θ as shown in FIG. 8, the preferable developer cleaning characteristics can be obtained. If the hardness of the elastic roller 71 and the contacting attitude of the cleaning blade 72 are related to achieve a<θ, the rotational load of the elastic roller 71 becomes too large and it is thus not preferable, Hereinafter, the cleaning mechanism for the intermediate transfer member using an elastic belt member will be described. FIG. 9 is an enlarged view for explaining a cleaning mechanism conducted at a winding area of a belt and FIG. 10 is an enlarged view for explaining a cleaning mechanism conducted at a linear movement area of the belt. In these drawings, numeral 81 designates a roller member, 82 designates an elastic belt member, 82*a* designates a belt backing material, 82*b* designates an elastic body, 83 designates a cleaning blade, 83*a* designates an outer layers and 84 designates a backup roller.

In the cleaning arrangement comprising the intermediate transfer member 40, the tension roller 42, and the intermediate transfer member cleaning blade 46 shown in FIG. 1 and also in the cleaning arrangement comprising the elastic belt member 82 having a surface coated with the elastic body 82*b* for carrying and conveying the developer, the roller member 81 around which the elastic belt member 82 is wound and which guides the movement of the elastic belt member 82, and the cleaning blade 83 which is in contact with the elastic belt member 82 to clean the surface of the elastic belt member 82 shown in FIG. 9, the angle θ of a contact face of the cleaning blade and the angle a of a rising contour of a deformed portion of the elastic body 82*b* coating the surface of the elastic belt member 82 are set to achieve the relation a>θ similar to the case described with reference to FIG. 8.

As for the intermediate transfer member which carries toner images sequentially primarily transferred and superposed from a plurality of image carriers (photoconductors) and secondarily transfers the toner images collectively, an elastic belt member is employed as a means for allowing the secondary transfer to a sheet medium even having an uneven surface because of fibers so as to improve the secondary transfer characteristics for transferring the toner image to the sheet medium in the secondary transfer process. The belt backing material of the elastic belt member of this case is made of polyimide or nickel electroformed tube or a stainless steel tube which has excellent bending durability and hardly expands against belt tension and has excellent heat resistance for resisting a heating process, if required, for coating the elastic body. The belt backing material has a thickness of from about 50 μm to 200 μm. The elastic body coating the surface of the belt backing material is made of a rubber material of which rubber hardness can be easily controlled such as polyurethane rubber, silicone rubber, or NBR and is formed to have a thickness of from about 100 μm to 600 μm. The rubber hardness of the elastic body is set to be JIS A of from 30 to 50 degrees. Since the elastic belt member as mentioned above is employed, the preferable elastic deformation can be obtained, thereby exhibiting good cleaning function.

As the means for reducing the friction coefficient of the rubber surface, the rubber surface is coated with a layer having a thickness of from 3 to 5 μm which is made of a resin of fluorine series such as PFA, PTFA, or the like or a resin of nylon series having a friction coefficient smaller than that of the rubber material or is covered by a tube having a thickness of from 3 to 10 μm which is made of the aforementioned resin, thereby reducing the frictional force generated at the portion pressed by the cleaning blade and also reducing the adhering force of toner particles carried by the surface of the elastic body and thus exhibiting excellent cleaning function.

To facilitate further preferable elastic deformation, the coating elastic body is made of foamed material in which a rubber material such as polyurethane rubber, silicone rubber or NBR is foamed at a desired foaming rate and the hardness of the foamed material is set to ASKER C of from 30 to 60 degrees (corresponding to JIS A of from 10 to 25 degrees). Therefore, further preferable elastic deformation is obtained, thereby exhibiting further excellent cleaning function.

As the means for reducing the friction coefficient of the rubber surface, foamed cell is covered by a tube having a thickness of from 3 to 10 μm made of a resin of fluorine series such as PFA, PTFA, or the like or a resin of nylon series having a friction coefficient smaller than that of the rubber material, thereby reducing the frictional force generated at the portion pressed by the cleaning blade and also reducing the adhering force of toner particles carried by the surface of the elastic body and thus exhibiting excellent cleaning function.

Also in the cleaning arrangement shown in FIG. 10 comprising the elastic belt member 82 having a surface coated with the elastic body 82*b* for carrying and conveying the developer, the cleaning blade 83 which is in contact with the elastic belt member 82 to clean the surface of the elastic belt member 82, and the backup roller (guiding member) 84 which backs up the elastic belt member 82 from the inside at a portion where is pressed by the cleaning blade 83 and guides the linear movement of the elastic belt member 82, the angle θ of a contact face of the cleaning blade and the angle a of a rising contour of a deformed portion of the elastic body 82*b* coating the surface of the elastic belt member 82 are set to achieve the relation a>θ. In this case, the electric belt member 82 has the same structure as the elastic belt member 82 shown in FIG. 9. The backup roller 84 as the guiding member is a roller member which rotates at the same velocity as the elastic belt member 82, that is, has a structure capable of reducing the movement resistance of the elastic belt member 82. However, the roller member is not limited to a rotatable roller member and may be a non-rotational roller member, for example, may be a simple flat fixed member. Preferably, the roller member is coated with a resin of fluorine series such as PFA, PTFA having a friction coefficient smaller than that of the elastic belt member 82 at a portion where the elastic belt member 82 is in contact during movement.

What is claimed is:

1. A developing device comprising a development roller for developing a latent image, the development roller having an elastic outer layer, a supplying roller that supplies liquid developer to the development roller, and a development roller cleaning blade which is in contact with the development roller to clean the surface of the development roller, the development roller having a toner charger, wherein where θ is an angle of a contact face of the development roller cleaning blade relative to a perpendicular line perpendicular to a generating line of the development roller at a contact point where the tip end of the development roller cleaning blade is pressed against and in contact with the development roller, and a is an angle of a rising contour of a deformed portion of the elastic outer layer which is deformed by the pressure of the development roller cleaning blade against the development roller relative to the perpendicular line, the hardness of the development roller and the attitude of the development roller cleaning blade are set to achieve a relation a>θ.

2. A developing device as claimed in claim 1, wherein the angle θ is in a range of from 6° to 30° .

3. An image forming apparatus comprising: an image carrier; a development roller for developing a latent image formed on the image carrier, the development roller having an elastic outer layer; a supplying roller that supplies liquid developer to the development roller; and a development roller cleaning blade which is in contact with the development roller to clean the surface of the development roller, the development roller having a toner charger, wherein where θ is an angle of a contact face of the development roller cleaning blade relative to a perpendicular line perpendicular to a generating line of the development roller at a contact point where the tip end of the development roller cleaning blade is pressed against and in contact with the development roller, and a is an angle of a rising contour of a deformed portion of the elastic outer layer which is deformed by the pressure of the development roller cleaning blade against the development roller relative to the perpendicular line, the hardness of the development roller and the attitude of the development roller cleaning blade are set to achieve a relation a>θ.

* * * * *